US008561978B2

(12) United States Patent
Takahashi et al.

(10) Patent No.: US 8,561,978 B2
(45) Date of Patent: Oct. 22, 2013

(54) IMAGE FORMING SYSTEM

(75) Inventors: Keita Takahashi, Abiko (JP); Naohisa Nagata, Moriya (JP); Akinobu Nishikata, Abiko (JP); Nobuo Sekiguchi, Moriya (JP); Tadaaki Saida, Kashiwa (JP); Satoshi Okawa, Toride (JP); Satoru Yamamoto, Abiko (JP); Hiroshi Matsumoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 661 days.

(21) Appl. No.: 12/606,393

(22) Filed: Oct. 27, 2009

(65) Prior Publication Data

US 2010/0117289 A1 May 13, 2010

(30) Foreign Application Priority Data

Nov. 11, 2008 (JP) ..... 2008-288355

(51) Int. Cl.
*B65H 83/00* (2006.01)

(52) U.S. Cl.
USPC ..... 271/3.01

(58) Field of Classification Search
USPC ..... 271/3.01, 3.05, 3.06, 3.08, 3.09, 3.13, 271/10.01, 9.01, 264, 298, 301, 291, 288, 271/3.03; 347/104; 101/224, 226; 400/621, 400/76, 646; 399/385, 388; 270/58.14, 270/58.18, 58.23; 83/102, 105, 107, 156, 83/401, 436.3, 167, 613, 614, 29, 86, 94
See application file for complete search history.

(56) References Cited

U.S. PATENT DOCUMENTS

| | | | | | |
|---|---|---|---|---|---|
| 3,612,511 | A | * | 10/1971 | Godlewski | 271/35 |
| 3,709,595 | A | * | 1/1973 | Turner et al. | 399/410 |
| 3,830,590 | A | * | 8/1974 | Harris et al. | 399/364 |
| 4,478,400 | A | * | 10/1984 | Commers | 271/3.03 |
| 4,866,472 | A | * | 9/1989 | Yamakoshi et al. | 355/27 |
| 4,968,014 | A | * | 11/1990 | Yamakoshi et al. | 271/3.06 |
| 5,474,287 | A | | 12/1995 | Takahashi | 271/10.13 |
| 5,512,993 | A | | 4/1996 | Endo et al. | 355/285 |
| 5,532,799 | A | | 7/1996 | Watanabe et al. | 355/245 |
| 5,575,463 | A | * | 11/1996 | Parkander | 270/52.02 |
| 5,588,758 | A | | 12/1996 | Yamamoto | 400/322 |
| 5,642,949 | A | | 7/1997 | Yamamoto | 400/322 |

(Continued)

FOREIGN PATENT DOCUMENTS

| | | | |
|---|---|---|---|
| JP | 59-86527 | * | 5/1984 |
| JP | 63-8131 | * | 1/1988 |

(Continued)

*Primary Examiner* — Thomas Morrison
(74) *Attorney, Agent, or Firm* — Fitzpatrick, Cella, Harper & Scinto

(57) ABSTRACT

An image forming system having: a sheet feeding unit which cuts a roll sheet and feeds cut sheets; a stack unit which stacks and stores the sheets fed by the sheet feeding unit and feeds the stored sheets; an image forming portion which forms an image on the sheets fed from the stack unit; and a controlling unit configured to control the feeding unit and the stack unit so that the stack unit feeds a sheet stored in the stack unit to the image forming portion when the sheet feeding unit feeds a sheet to the stack unit so as to stack the sheet from the sheet feeding unit into the stack unit.

20 Claims, 16 Drawing Sheets

(56) References Cited

U.S. PATENT DOCUMENTS

| | | | | |
|---|---|---|---|---|
| 6,246,491 | B1 | 6/2001 | Matsumoto et al. | 358/468 |
| 6,397,035 | B2 | 5/2002 | Kataoka et al. | 399/388 |
| 6,751,426 | B2 | 6/2004 | Akiba et al. | 399/82 |
| 6,793,425 | B2 | 9/2004 | Yoshikawa et al. | 400/624 |
| 7,050,751 | B2 | 5/2006 | Watanabe et al. | 399/391 |
| 7,391,980 | B2 | 6/2008 | Sekiguchi et al. | 399/20 |
| 2008/0246205 | A1 | 10/2008 | Fujii et al. | 270/58.08 |
| 2009/0323094 | A1 | 12/2009 | Hayashi et al. | 358/1.12 |

FOREIGN PATENT DOCUMENTS

| | | | |
|---|---|---|---|
| JP | 1-106060 | * | 4/1989 |
| JP | 2005-250273 | | 9/2005 |
| JP | 2007-136717 | | 6/2007 |

* cited by examiner

IMAGE FORMING SYSTEM

BACKGROUND OF THE INVENTION

1. Field of the Invention

The present invention relates to an image forming system which cuts a roll sheet to form an image by an image forming portion.

2. Description of Related Art

In recent years, the print demand has been changed. Print on demand (hereinafter, referred to as "POD") for performing various small-lot prints has been increased in comparison with the demand for printing a large quantity of the same print matters. In the print demand like POD, cost and time loss are high in an offset printing apparatus which needs to make a printing plate and a screen for each print like a printing press. There have been great expectations for an electrophotograph image forming apparatus.

In the related art, many electrophotograph image forming apparatuses store recording sheets which are cut to a predetermined size such as an A system or a B system in a paper manufacturing process in a feeding deck and feed them one by one therefrom to perform image formation. Such feeding system is assumed to be used in offices and at home. As in the offset printing apparatus, when a large number of recording sheets are printed, they run out in the feeding deck immediately. A large-capacity feeding deck which increases a storable number of sheets has been typically known. The recent technical progress has been remarkable. The productivity of the electrophotograph image forming apparatus has been improved drastically. The problem that the sheets run out immediately even in the large-capacity feeding deck cannot be solved.

In recent years, it has been proposed that the problem is solved by multiply-coupling the large-capacity feeding decks. The problem that sheets to be fed run out immediately can be solved by multiply-coupling the large-capacity feeding decks. The cost for preparing for plural large-capacity feeding decks is increased. The entire apparatus is made larger.

As a method for solving these problems, there has been typically known a roll sheet feeding unit as seen in the offset printing apparatus, in which an uncut roll sheet is provided and is cut at the time of printing for feeding. An apparatus in which the roll sheet unit is attached to the electrophotograph image forming apparatus has been actually proposed (Japanese Patent Application Laid-Open (JP-A) No. 2005-250273).

The roll sheet feeding unit can produce recording sheets of which number is larger than that of the recording sheets previously cut. The frequency in which the sheets to be fed run out can be reduced. There is a merit that the cost for feeding the recording sheets can be reduced.

Japanese Patent Application Laid-Open (JP-A) No. 2007-136717 discloses a configuration which cuts a roll sheet so as to stack and store cut sheets in a storage portion and feeds the sheets from the storage portion to the image forming portion. The operation of cutting the roll sheet and feeding the cut sheets to the storage portion so as to stack them in the storage portion and the operation of feeding the sheets from the storage portion to the image forming portion cannot be performed at the same time. The productivity of the configuration of JP-A No. 2007-136717 is low.

SUMMARY OF THE INVENTION

The present invention provides an image forming system which uses a roll sheet to efficiently feed cut sheets for enabling image formation.

The representative configuration in the present invention for solving the above problems is an image forming system having: a sheet feeding unit which cuts a roll sheet and feeds cut sheets, a stack unit which stacks and stores the sheets fed by the sheet feeding unit and feeds the stored sheets, an image forming portion which forms an image on the sheets fed from the stack unit, and a controlling unit configured to control the feeding unit and the stack unit so that the stack unit feeds a sheet stored in the stack unit to the image forming portion when the sheet feeding unit feeds a sheet to the stack unit so as to stack the sheet from the sheet feeding unit into the stack unit.

The present invention can provide the image forming system which uses the roll sheet to efficiently feed the cut sheets for enabling image formation.

Further features of the present invention will become apparent from the following description of exemplary embodiments (with reference to the attached drawings).

DESCRIPTION OF THE EMBODIMENTS

An image forming system according to an embodiment of the present invention will be described specifically with reference to the drawings.

[First Embodiment]

The Overall Configuration of the Image Forming System

Figure 1:
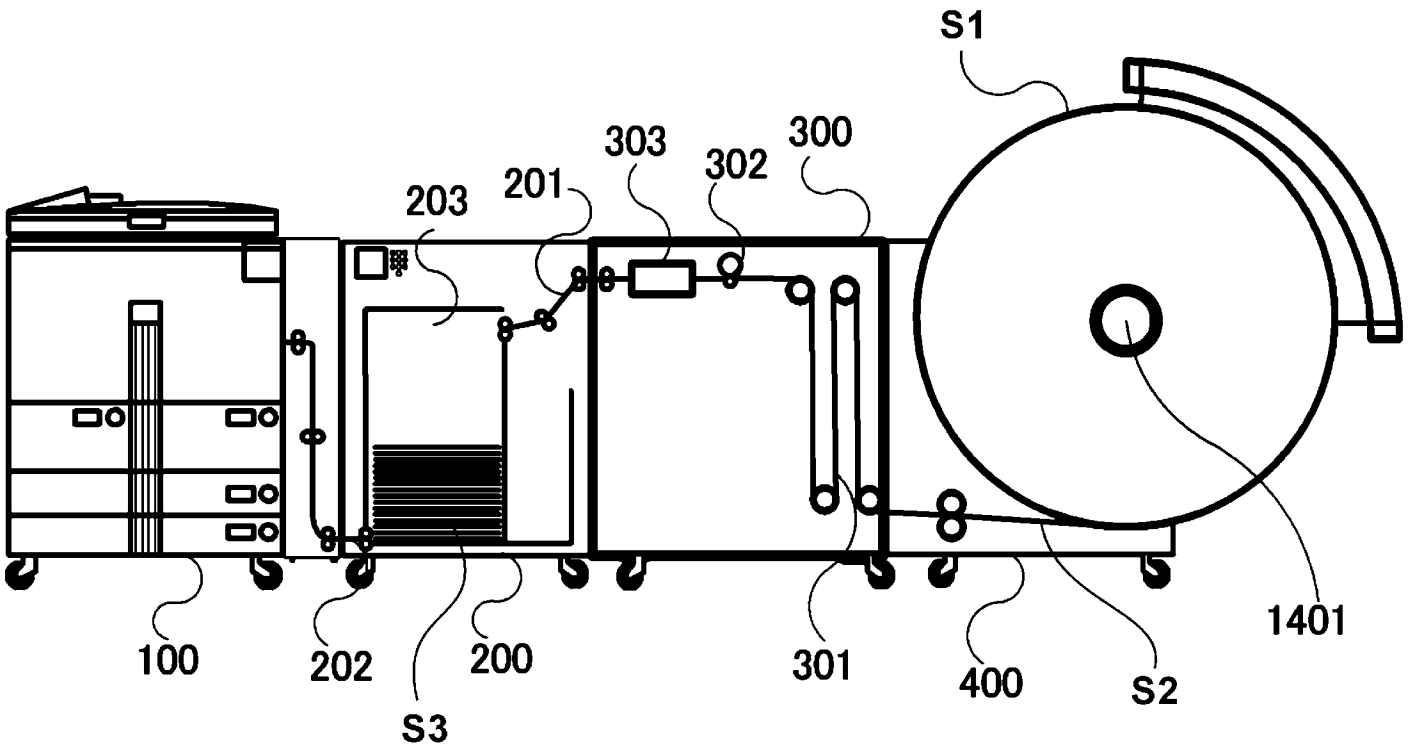
FIG. 1 is a diagram illustrating the configuration of an image forming system according to a first embodiment.

The overall configuration of the image forming system will be described with reference to FIG. 1. FIG. 1 is a configuration diagram illustrating the image forming system according to the first embodiment. A roll sheet is cut to a predetermined size and cut recording sheets are then fed to an image forming apparatus.

The image forming system according to this embodiment is largely divided into an image forming apparatus 100, a recording sheet stack unit 200, a roll sheet cut unit 300, and a roll drive unit 400.

The roll drive unit 400 and the roll sheet cut unit 300 configure a sheet feeding unit which feeds a roll sheet S2 from a sheet roll S1 on which the sheet is wound, cuts the roll sheet S2 to a predetermined size, and feeds cut sheets S3. The recording sheet stack unit 200 configures a stack unit which stacks and stores the cut sheets.

The roll S1 on which the long sheet is wound is rotatably attached to the roll drive unit 400. A rotational shaft 1401 is rotated by a driving source, not illustrated, to rotate the roll S1, thereby feeding the roll sheet S2. The fed roll sheet S2 is cut to the predetermined size by the roll sheet cut unit 300. The cut sheets cut by the roll sheet cut unit 300 are conveyed to the recording sheet stack unit 200 and are then stacked in a recording sheet stack portion 203. When performing image formation, the image forming apparatus 100 as an image forming portion feeds the cut sheets stacked in the recording sheet stack portion 203 to perform recording.

<Image Forming Apparatus>

Figure 2:
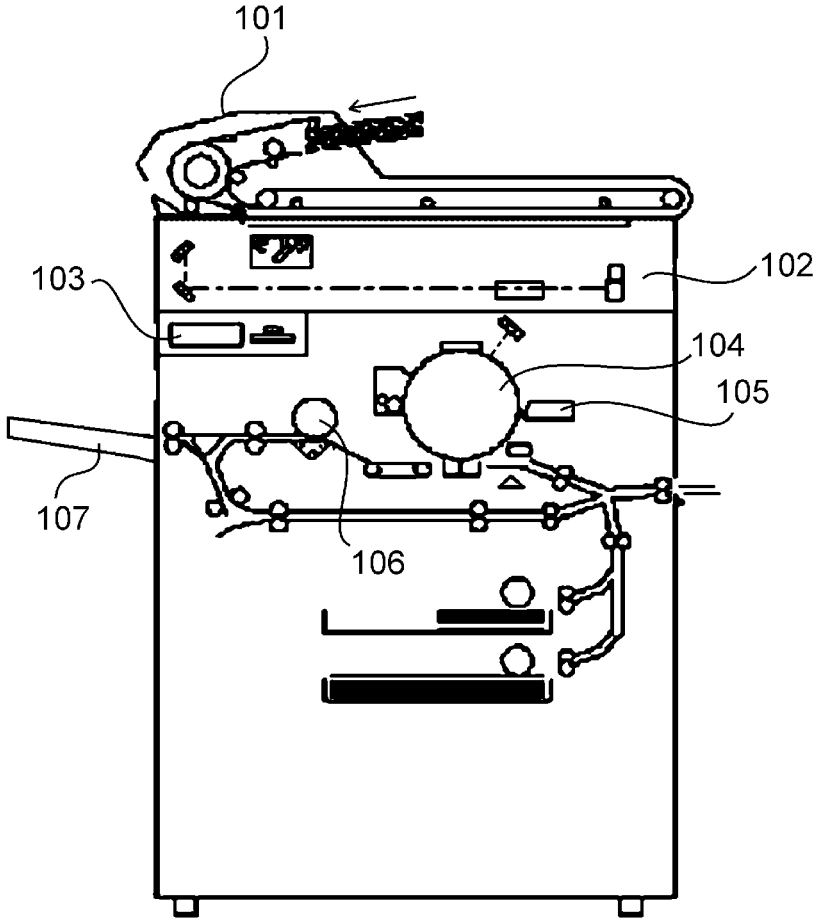
FIG. 2 is an explanatory view of an image forming apparatus according to the first embodiment.

The image forming apparatus 100 of this embodiment is a copying machine which performs printing by an electrophotograph process. FIG. 2 is a cross-sectional view of the image forming apparatus 100. Information described on an original conveyed by an original conveying apparatus 101 is optically read by a reading portion 102 and is then converted to a digital signal so as to be transmitted to an exposure portion 103.

The read information is recorded onto a recording sheet by the image forming portion. Specifically, a photosensitive drum 104 is irradiated with a laser beam output by the exposure portion 103 and an electrostatic latent image is formed on the photosensitive drum 104. The electrostatic latent image on the photosensitive drum 104 is toner developed by a development device 105 so as to be a visible image. The toner image is transferred onto the conveyed sheet for image formation, is fixed by a fixing device 106, and is discharged onto a discharge tray 107.

<Sheet Stack Unit>

Figure 3:
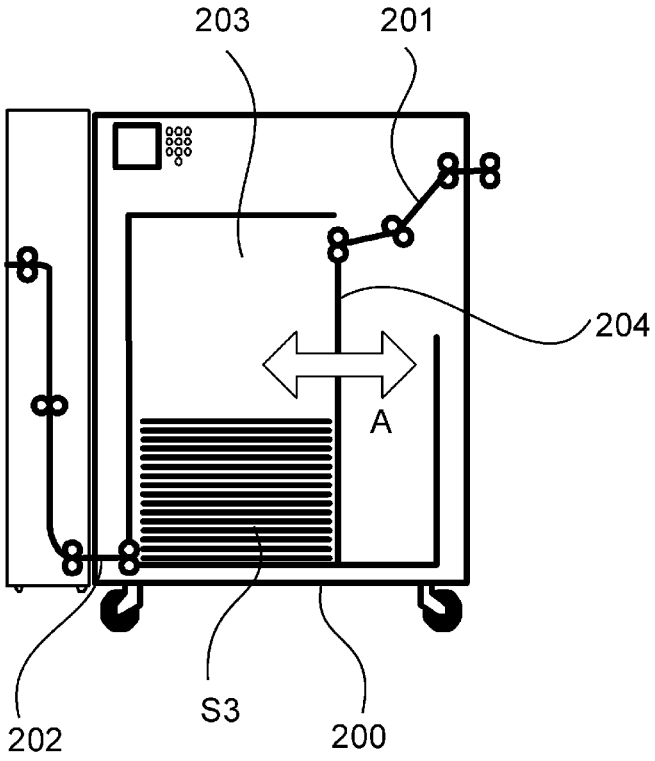
FIG. 3 is an explanatory view of stack control according to the first embodiment.

The sheet stack unit 200 as a stack unit will be described. FIG. 3 is an explanatory view of the cross section of the sheet stack unit.

The cut sheets S3 cut by the roll sheet cut unit 300 are fed to the sheet stack unit 200. These cut sheets are stacked in the recording sheet stack portion 203. A regulation plate 204 of the recording sheet stack portion 203 is slidable in the double-headed arrow A direction of FIG. 3 by a moving unit, not illustrated. This enables the setting of an operation portion by the user or the changing of the stackable size of the recording sheet stack portion 203 according to the size of the recording sheets determined from the contents of a job. In this embodiment, the size of the recording sheets is transmitted from a controlling portion of the image forming apparatus 100 and the position of the regulation plate 204 is changed according to the sheet size based on this information.

To align the fed recording sheets, the regulation plate 204 performs a regulation operation, if necessary, and aligns the cut sheets fed from a feeding path 201 so that they are not disordered.

The recording sheet stack portion 203 has a feeding portion (a supplying unit) 202 which receives a feeding signal and feeds the cut sheets to the image forming portion when the image forming apparatus 100 performs image formation. The feeding portion 202 separates the lowermost sheet stacked in the recording sheet stack portion 203 from other sheets and then feeds (supplies) the sheet to the image forming apparatus 100. The sheets are fed from the sheet stack unit 200 to the image forming apparatus 100 and, at the same time, the cut sheets fed from the roll sheet cut unit 300 can be stacked on the stacked sheets.

The quantity of the cut sheets S3 stacked in the recording sheet stack portion 203 is determined depending on the productivity of the roll sheet cut unit 300 and the roll drive unit 400. The quantity of the recording sheets fed from the recording sheet stack portion 203 to the image forming portion of the image forming apparatus 100 is determined depending on the productivity of the image forming apparatus 100.

<Roll Sheet Cut Unit>

Next, the roll sheet cut unit 300 as a sheet feeding unit will be described. In FIG. 1, the roll sheet cut unit 300 has a roll sheet slacking portion 301 which slacks the roll sheet, a decurler portion 302 which decurls the roll sheet, and a cutter unit portion 303 which cuts the roll sheet to a predetermined size.

The roll sheet slacking portion 301 slacks the roll sheet when the feeding speed of the roll sheet S2 fed from the roll drive unit 400 is higher than that of the cut sheets S3 fed to the image forming apparatus. This prevents the excessive feeding of the roll sheet from the roll drive unit 400.

The fed roll sheet S2 is curled in a roll direction and is decurled by the decurler portion 302. The decurler portion 302 has a pair of pressed rollers. When passing through the nip of the pair of rollers, the sheet is decurled. The decurl amount can be controlled by changing the nip pressure of the pair of rollers by a pressing mechanism, not illustrated.

The decurler portion 302 controls the decurl amount according to the remaining amount of the sheet, the thickness of the sheet, and the type of the sheet held in a memory portion. As the remaining amount of the sheet is reduced, the roll diameter of the sheet is smaller and the curl amount is larger. As the remaining amount of the sheet is reduced, the decurl amount is larger.

The cutter unit portion 303 is a unit which cuts the conveyed roll sheet to a desired conveying direction length by a cutter (not illustrated) and feeds cut sheets into the recording sheet stack portion 203. For cutting by the cutter, the length of the sheets is measured by an encoder attached to the roller conveying the sheets to determine the cutting timing.

After cutting, the cut sheets are conveyed at a speed higher than the roll sheet feeding speed and are then fed to the image forming apparatus while a constant interval between the sheets is held. Cutting by the cutter is executed after the sheet conveyance is stopped. At the time of the sheet cutting, the roll sheet is fed from the roll drive unit 400. The sheet of the feeding length is held while a constant tension is applied by the roll sheet slacking portion 301.

<Feeding and Cutting of the Roll Sheet>

Figure 4:
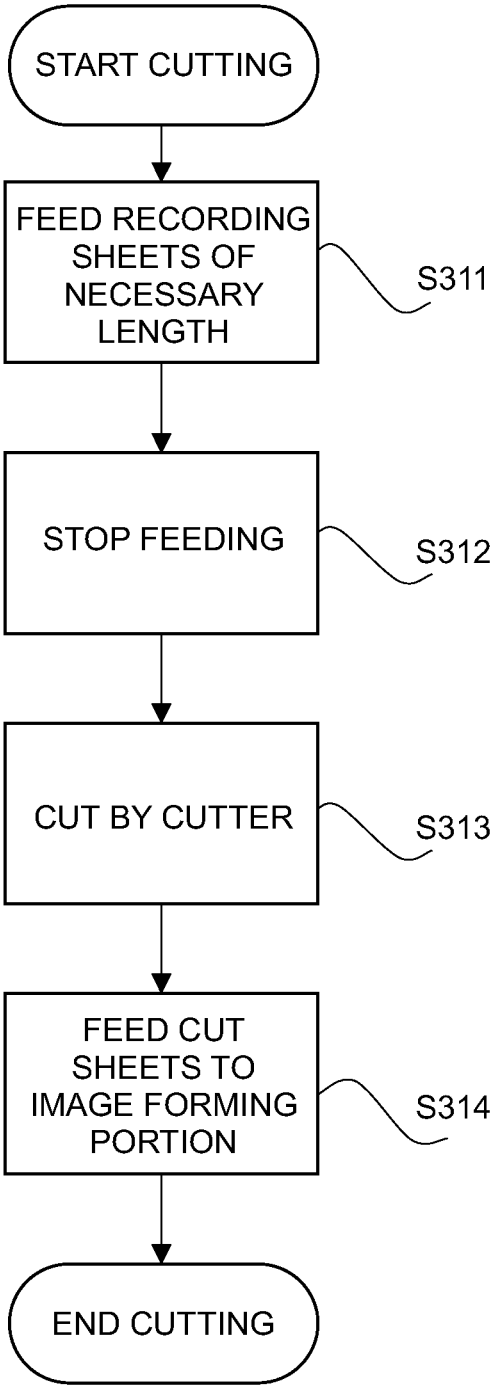
FIG. 4 is an explanatory view of cut control according to the first embodiment.

As illustrated in the flowchart of FIG. 4, for the cutting of the roll sheet, the roll on which the sheet is wound is rotated so that the roll sheet is fed so as to have a predetermined length (S311). The drive of the roll is stopped (S312) to fix the position of the sheet. Cutting by the cutter is performed (S313). Finally, the cut sheets are conveyed to the image forming portion (S314).

Figure 5:
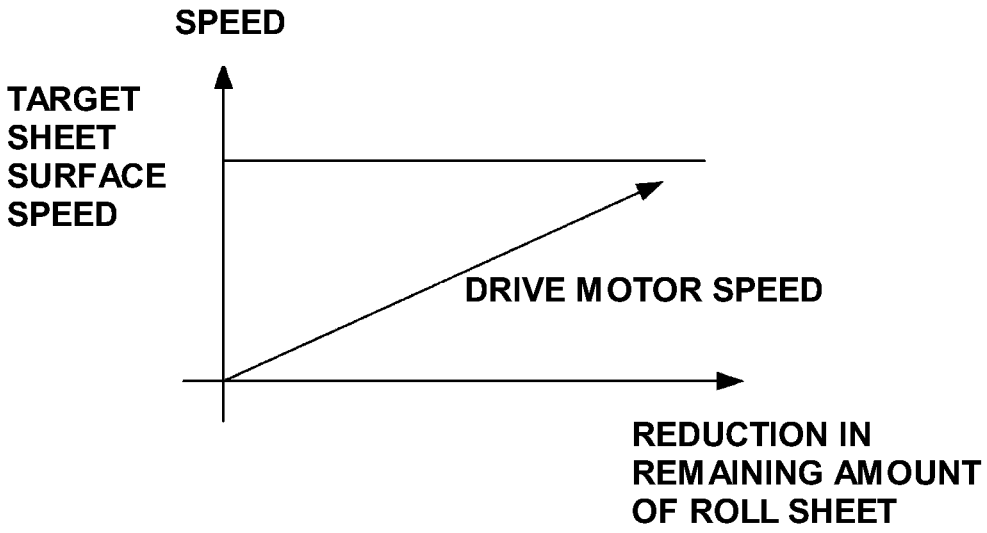
FIG. 5 is an explanatory view of roll sheet drive control according to the first embodiment.

The feeding of the roll sheet is controlled according to the remaining amount of the roll sheet and the thickness of the sheet. FIG. 5 is a diagram illustrating the relation between the remaining amount of the roll sheet, a roll motor rotating the roll, and a sheet surface speed.

In order to make the sheet feeding speed (sheet surface speed) constant, the roll motor need be controlled based on the remaining amount of the roll sheet itself. The roll diameter and the sheet surface speed are changed according to the remaining amount of the sheet. It is necessary to consider the speed according to the thickness of the roll sheet. In FIG. 5, when the remaining amount of the sheet is large, the roll motor is rotated at a low speed and the motor speed is increased with the reduction of the remaining amount of the roll sheet. An encoder unit, not illustrated, is provided in the roll motor, detects the motor speed all the time, and compensates for the driving speed of the motor in the event that a shift from the target speed occurs.

The controlling portion of the image forming apparatus 100 controls the remaining amount of the roll sheet by summation of sheet lengths stored in the memory portion, not illustrated. The remaining amount of the roll sheet is calculated based on the number of rotations counted by the encoder provided in the roll motor and the thickness of the sheet stored in the memory portion. It is because when the thickness of the sheet is large at the same number of rotations, the rate to the entire amount of the sheet used is high.

Namely, the driving speed of the roll motor is increased as the remaining amount of the roll sheet is smaller. As compared with the thin sheet, the thick sheet increases the rate of the change in the speed of the roll motor. This can make the sheet surface speed constant to feed the roll sheet.

<Controlling Portion>

Figure 6:
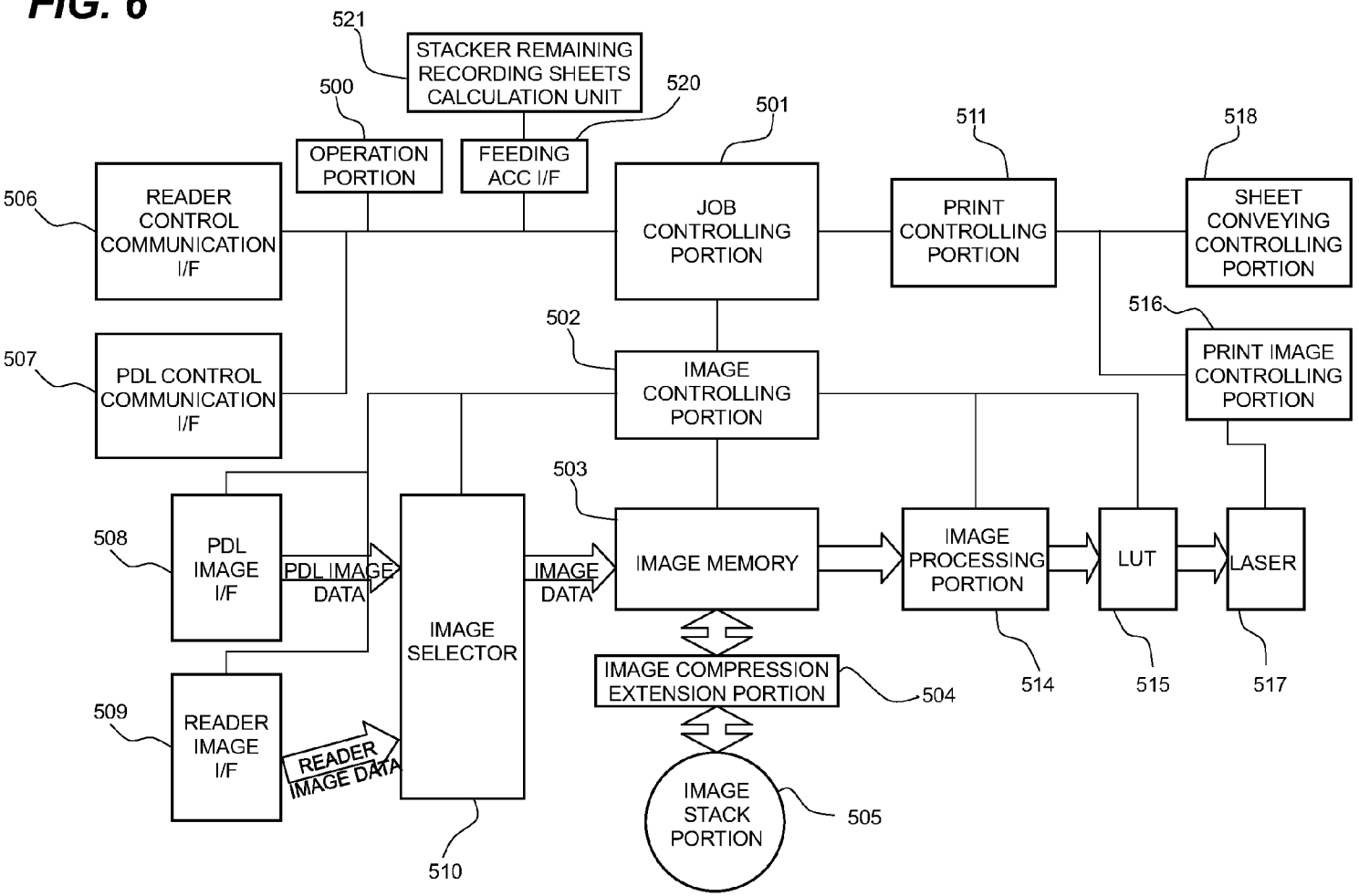
FIG. 6 is an explanatory view of a block diagram according to the first embodiment.

FIG. 6 is a circuit block diagram illustrating the circuit configuration of the image forming apparatus 100. An operation portion 500 is connected to a job controlling portion 501 which is a circuit including a ROM into which a program for controlling the image forming apparatus 100 is written, a RAM which develops the program, and a CPU executing the program. The contents instructed from the operation portion 500 are informed to the job controlling portion 501.

A feeding ACC I/F (Interface) 520 is a feeding accessory or in this embodiment, a circuit for communication with the roll drive unit 400. Data exchange with the roll drive unit 400 is realized using this circuit. A stacker remaining recording sheets calculation unit 521 calculates the number of the sheets fed to the recording sheet stack unit 200 and the number of the sheets fed from the recording sheet stack unit 200 based on data communicated via the feeding ACC I/F 520. The number of sheets stored in the recording sheet stack unit 200 is calculated.

A copy job and a scan job are generated according to the informed operation mode by the program of the job controlling portion 501. The job controlling portion 501 is connected to a reader control communication I/F 506, a PDL control communication I/F 507, and a print controlling portion 511. The entire control of the image forming apparatus 100 is managed by the job controlling portion 501.

The reader control communication I/F 506 is a communication I/F with a CPU circuit, not illustrated, which controls the reading portion 102 reading an original image. The PDL control communication I/F 507 is a communication I/F with a CPU circuit of a PDL image controlling portion, not illustrated, which develops PDL image data transmitted from a personal computer, not illustrated, to a bitmap image. The print controlling portion 511 drive controls the image controlling portion 502 which controls image data to generate image data which transmits the PDL image and the reader image to each development station of the image forming apparatus 100 and each load and forms an image.

An image controlling portion 502 is a circuit which sets each image related circuit according to the job generated by the job controlling portion 501. In this embodiment, the image controlling portion 502 sets an image selector 510 which determines which of the PDL image data transmitted from a PDL image I/F 508 and the reader image transmitted from a reader image I/F 509 is effective to an image memory 503. The image controlling portion 502 sets in which area of the image memory 503 the image data from the image selector 510 is stored. The image controlling portion 502 performs the setting of an image stacking portion 505 configured by a nonvolatile memory typified by a hard disk, the setting of compressing the bitmap image data from the image memory 503 to transmit the compressed data to the image stacking portion 505, and the setting of an image compression extension portion 504 which extends the compressed image data from the image stacking portion 505 to return the extended data to the image memory 503. To actually develop and record the image data, color image data is read from the image memory 503 and is then subjected to desired image processing by an image processing portion 514.

The print controlling portion 511 receives image data of color finally transmitted by a color decomposition portion 516 according to each of the settings of the image controlling portion 502 set by the contents instructed from the job controlling portion 501. The print controlling portion 511 provides an instruction to a print image controlling portion 513 so as to transmit the image data to an exposure controlling portion 110. The print image controlling portion 513 sets an LUT (Look Up Table) 515 in which the sensitivity characteristic of the photosensitive member is reflected to the image data according to the instruction from the print controlling portion 511. The LUT 515 also changes the image density of the input image data to a desired density when the image density is not the desired density due to the change in the sensitivity characteristic on the photosensitive member, the laser exposure amount, and the charging amount from a primary charger. The image data via the LUT 515 of each color is output to a laser beam circuit portion 517. A latent image is formed on the photosensitive member by the development device 105.

A sheet conveying controlling portion 518 controls the sheet conveyance by the image forming apparatus 100 and the operations of the sheet stack unit 200, the roll drive unit 400, and the roll sheet cut unit 300.

When the cut sheets are stored in the sheet stack portion 203, the sheet size selected from the operation portion 500 is informed to cut the roll sheet S1 so as to have the specified size by the cutter unit portion 303. The informing of the size is selected by pressing the select button for each size provided in the operation portion 500. When the sheets are stacked in the recording sheet stack portion 203, only the previously specified size is selectable.

<Timing for Feeding the Cut Sheets to the Sheet Stack Portion>

Timing for feeding the cut sheets to the sheet stack portion of this embodiment will be described.

Figure 7A:
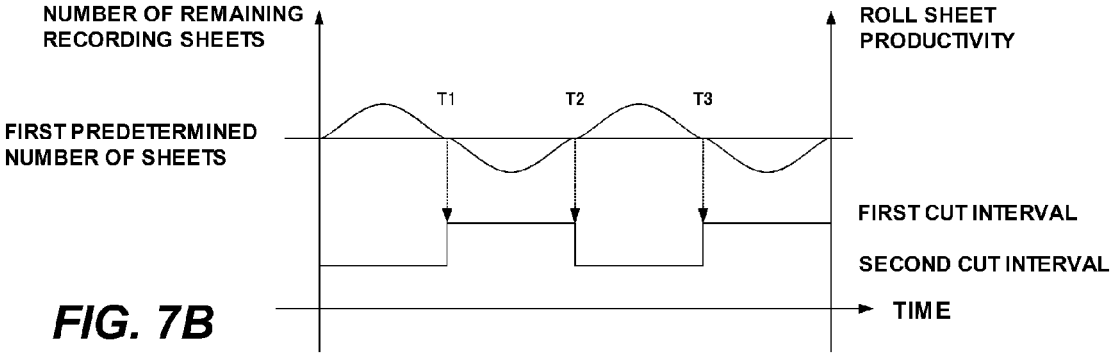
FIGS. 7A and 7B are diagrams illustrating the relation between cut intervals and the number of remaining recording sheets according to the first embodiment.

In this embodiment, as illustrated in FIG. 7A, the cut interval of the roll sheet cut unit 300 is controlled according to the quantity of the remaining recording sheets stored in the recording sheet stack portion 203.

The image forming interval for each of the sheets of the image forming portion for continuous image formation is t1, and the feeding interval for each of the sheets in which the sheets cut by the roll sheet cut unit 300 is continuously fed to the sheet stack unit 200 is t2. The feeding state of the cut sheets from the roll sheet cut unit 300 can be switched between a first sheet feeding state in the relation of t1<t2 and a second sheet feeding state in the relation of t1>t2. According to the result from a sheet quantity determination unit (stack quantity detection unit) which determines the quantity of the sheets (stack quantity) stacked in the sheet stack unit 200, when the quantity of the stacked sheets is below a predetermined quantity, the sheets are fed to the sheet stack unit 200 in the first sheet feeding state. When the quantity of the stacked sheets is above the predetermined quantity, the sheets are fed to the sheet stack unit 200 in the second sheet feeding state.

This operation will be described specifically. When image formation is started, the recording sheets are fed from the sheet stack portion 203 to the image forming apparatus. The recording sheet stack portion 203 stores over a predetermined number of the recording sheets (a first predetermined number of sheets) until a timing T1. The roll sheet cut unit 300 cuts the roll sheet at a predetermined second cut interval to feed the cut sheets to the sheet stack unit 200 (the second feeding state). The cut interval is longer than the feeding interval of the cut sheets to the image forming portion. Therefore the quantity of the cut sheets stacked in the sheet stack unit 200 is reduced.

When the number of the recording sheets stacked in the sheet stack unit 200 at the timing T1 is below the first predetermined number of sheets, the roll sheet cut unit 300 cuts the roll sheet at a first cut interval which is a cut interval shorter than the second cut interval to feed the cut sheets to the sheet stack unit 200 (the first feeding state).

The first cut interval is shorter than the feeding interval of the cut sheets to the image forming portion. Therefore, the number of the cut sheets stacked in the sheet stack unit 200 is increased. At a timing T2, the quantity of the remaining recording sheets is above the first predetermined number of sheets again. The roll sheet cut unit 300 cuts the recording sheets at the second cut interval again. When the quantity of the remaining recording sheets is below the first predetermined number of sheets at a timing T3, the recording sheets are cut at the first cut interval again for feeding.

Figure 7B:
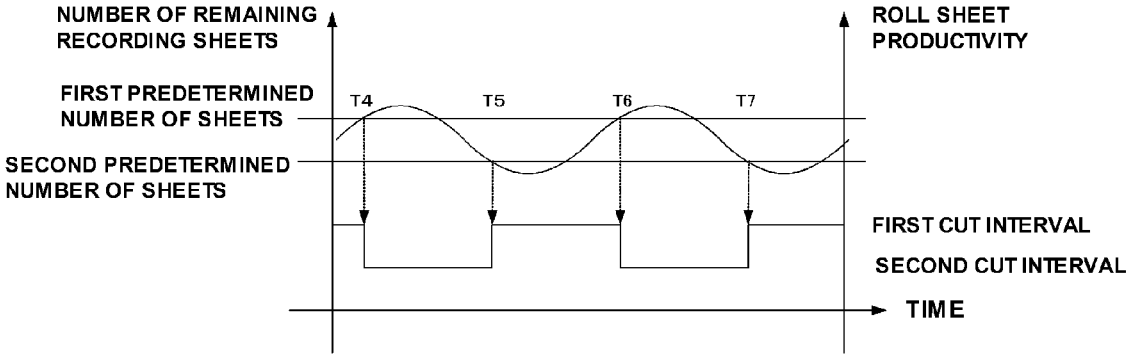

FIG. 7B is a diagram illustrating a pattern having plural threshold values (the first predetermined number of sheets and the second predetermined number of sheets) of the quantity of the remaining recording sheets determining the switching between the first cut interval and the second cut interval from timings T4 to T7. When the maximum stackable number of sheets in the sheet stack unit 200 is 6000, the first predetermined number of sheets is set to 4000 and the second predetermined number of sheets is set to 2000. The image forming interval is set to 70 ppm, the first cut interval is set to 60 ppm, and the second cut interval is set to 80 ppm, thereby cutting the roll sheet for feeding.

The plural thresholds of the quantity of the remaining sheets stacked in the sheet stack unit 200 may be set to switch between the first cut interval and the second cut interval.

Figure 8:
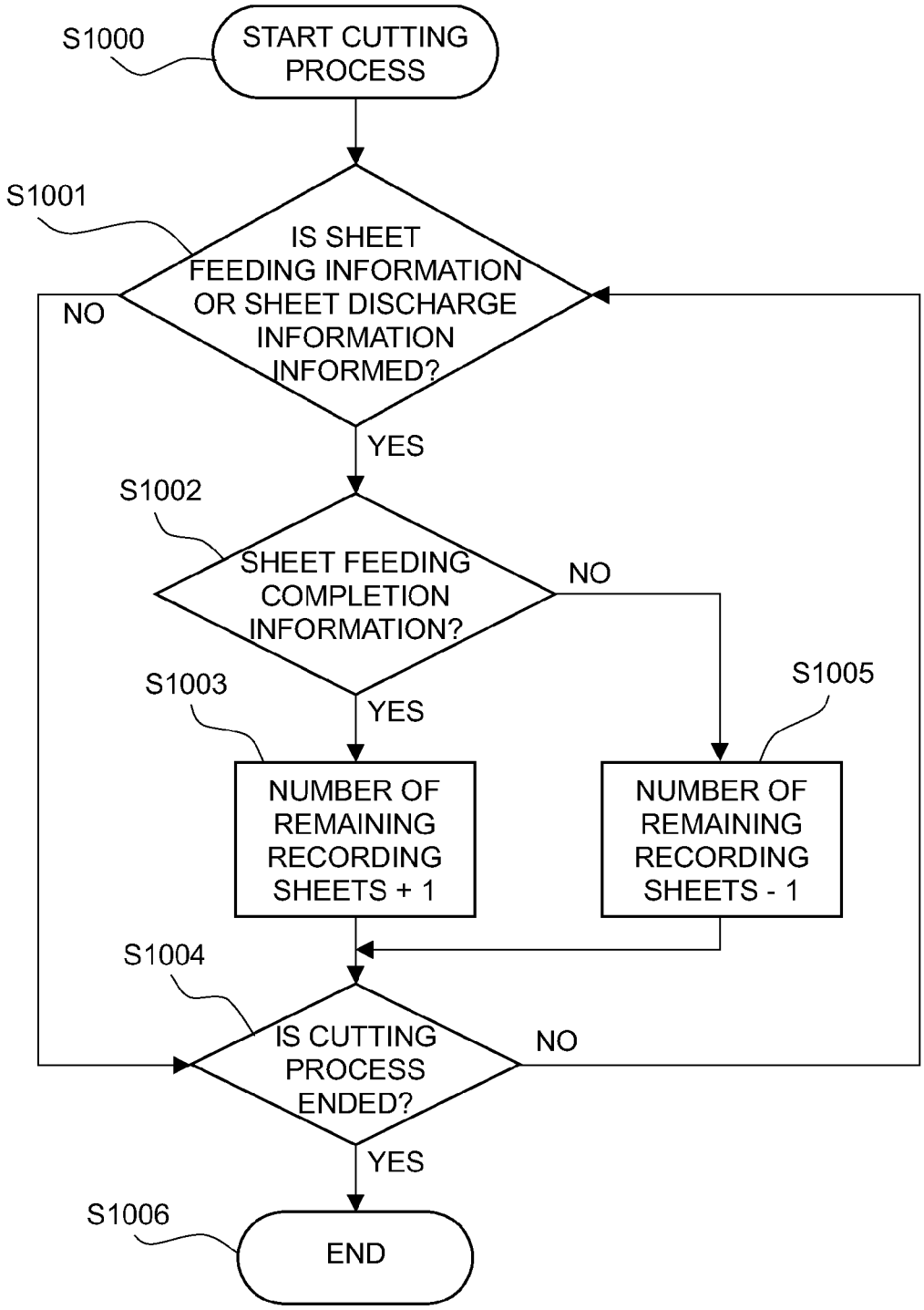
FIG. 8 is a flowchart which counts the number of remaining recording sheets according to the first embodiment.

There will be described a flowchart which detects the number of the remaining recording sheets in the sheet stack unit 200 feeding the recording sheets to the image forming apparatus 100 by the stacker remaining recording sheets calculation unit 521 as the stack quantity detection unit will be described with reference to FIG. 8.

When the cut process is started in S1000, the sheet feeding completion information or the sheet discharge completion information is received from the recording sheet stack unit 200 via a feeding ACC I/F 320. The sheet feeding completion information is informed when the recording sheets are fed by the roll sheet cut unit 300. The sheet discharge completion information is informed when the feeding of the recording sheets is completed from the recording sheet stack unit 200 to the image forming apparatus 100. In S1001, the informing of either the sheet feeding completion information or the sheet discharge completion information is waited for and, if there is no informing, the routine is advanced to S1004. If there is informing, the routine is advanced to S1002 to determine whether the informed information is the feeding completion information. If the informed information is the feeding completion information, one is added to the number of the remaining recording sheets in S1003. If not, one is subtracted from the number of the remaining recording sheets in S1005. In S1004, it is determined whether the cut process of the roll sheet is ended. If the cut process of the roll sheet is ended, the routine is advanced to S1006 to end the process. If the cut process is continued, the routine is returned to S1001 to check whether the feeding completion information or the discharge completion information is informed.

Figure 9:
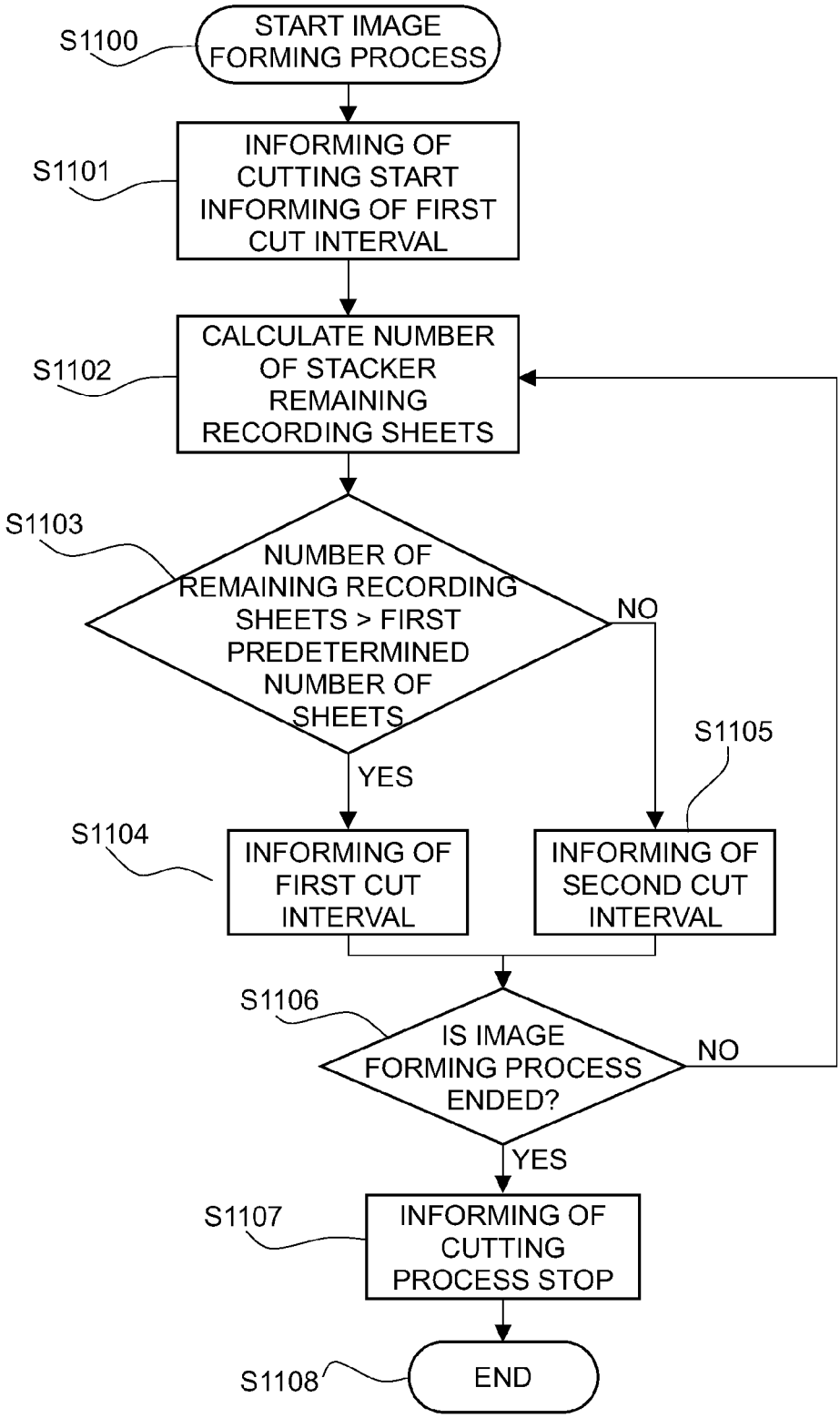
FIG. 9 is a flowchart which controls the cut intervals according to the first embodiment.

FIG. 9 is a diagram describing a flowchart which switches the cut intervals of the roll sheet cut unit 300 according to the remaining recording sheets in the recording sheet stack unit 200.

When the image forming process is started in S1100, the first cut interval is informed via the feeding ACC I/F 320 to the roll sheet cut unit 300 in S1101. In S1102, the number of the remaining recording sheets in the recording sheet stack unit 200 detected by the flowchart of FIG. 8 is read to determine in S1103 whether the number of the remaining recording sheets is above the first predetermined number of sheets. If the number of the remaining recording sheets is above the first predetermined number of sheets, the first cut interval is informed to the roll sheet cut unit 300. If the number of the remaining recording sheets is below the first predetermined number of sheets, the second cut interval is informed. In S1106, it is checked whether the image forming process is continued. If the image forming process is continued, the routine is returned to S1102. If the image forming process is ended, the routine is advanced to S1107 to inform the cut process stop to the roll sheet cut unit 300, thereby ending the image forming process in S1108.

The sheets are thus fed in this way. The image forming system which uses the roll sheet to efficiently feed the cut sheets for enabling image formation can be provided.

In this embodiment, the state of cutting the roll sheet to feed the cut sheets to the sheet stack unit 200 is changed in association with the sheet intervals in the image forming portion. When the detection unit detects that the quantity of the sheets stacked in the sheet stack unit 200 is below the predetermined quantity, the roll sheet cut unit 300 may feed the sheets to the sheet stack unit 200.

In the above description, there has been illustrated the example in which the lowermost one of the sheets stacked in the sheet stack unit 200 is fed to the image forming apparatus 100. The uppermost sheet may be fed to the image forming apparatus 100.

There has been illustrated the form in which the control of the sheet stack unit 200, the roll sheet cut unit 300, and the roll drive unit 400 is performed by the sheet conveying controlling portion 518 of the image forming apparatus 100. A controller may be provided in the sheet stack unit 200 or the roll sheet cut unit 300 so that the controller arranged in the sheet stack unit 200 or the roll sheet cut unit 300 may control the sheet stack unit 200, the roll sheet cut unit 300, and the roll drive unit 400 according to a request from the image forming apparatus 100. The controller may be provided in each of the units.

[Second Embodiment]

An apparatus according to a second embodiment will be described. The basic configuration of the apparatus of this embodiment is the same as the first embodiment and the overlapped description is omitted. The configuration which is the feature of this embodiment will be described here.

In the first embodiment, there has been illustrated the example in which the feeding speed of the cut sheets to be fed to the sheet stack unit 200 is changed corresponding to the image forming speed. In this embodiment, the sheet feeding speed is changed according to the quantity of the sheets stacked in the sheet stack unit 200.

Specifically, the quantity of the sheets stacked in the sheet stack unit 200 is detected and, when the quantity of the sheets is below the predetermined quantity, the feeding speed of the cut sheets from the roll sheet cut unit 300 is higher than the set value. When the quantity of the sheets stacked in the sheet stack unit 200 is above the predetermined quantity, the feeding speed of the cut sheets from the roll sheet cut unit 300 is lower than the set value.

Figure 10:
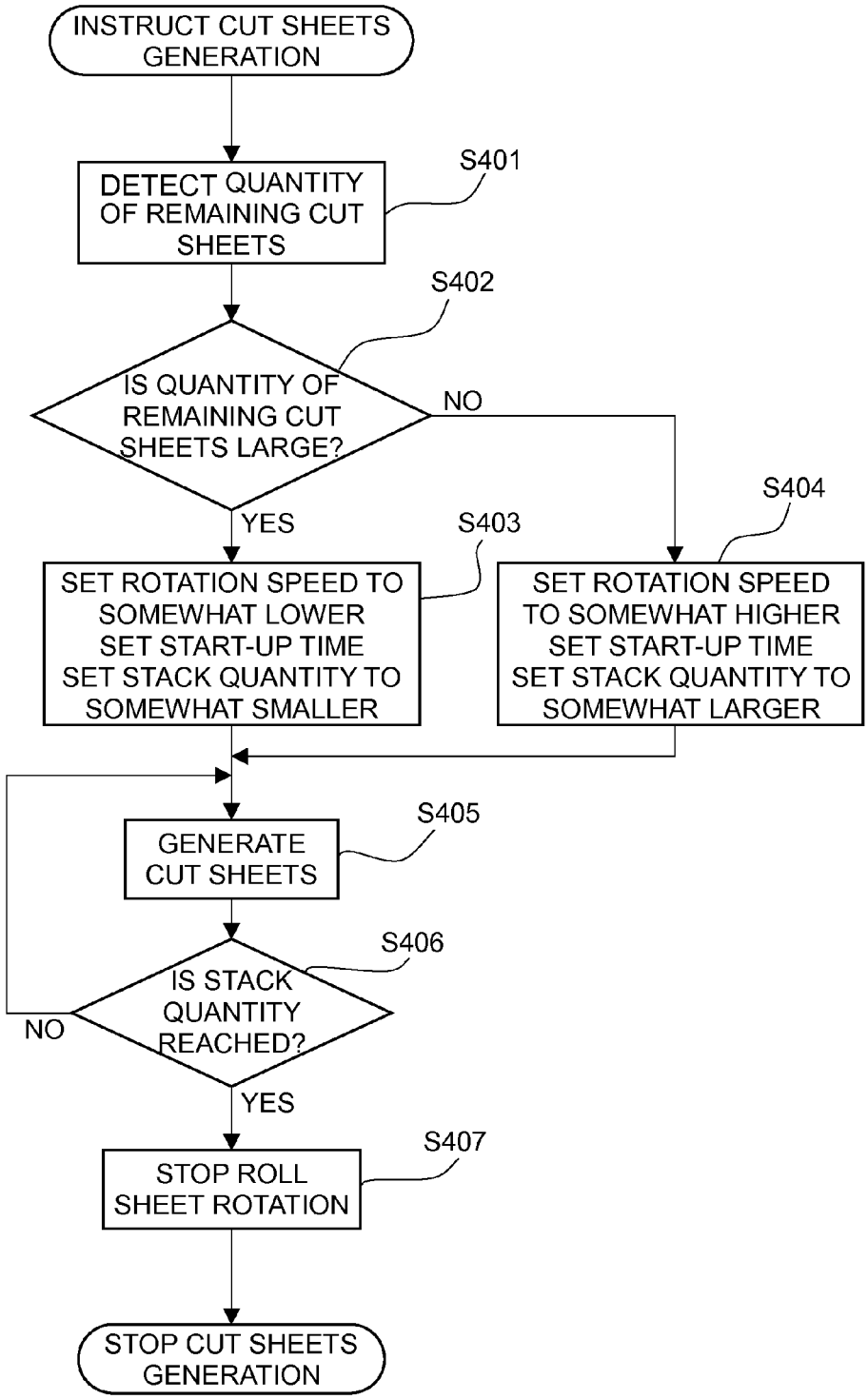
FIG. 10 is a flowchart of cut sheet feeding control according to a second embodiment.

The control procedure for that operation is illustrated in the flowchart of FIG. 10. As illustrated in FIG. 10, in this embodiment, when the cut sheets are fed, the quantity of the remaining cut sheets stacked in the sheet stack unit 200 is detected by the sheet quantity detecting unit (S401). If the quantity of the remaining sheets is above the predetermined quantity, the rotation speed of the sheet roll by the roll drive unit 400 is set to be lower than the reference value and the feeding speed of the cut sheets to the sheet stack unit 200 is decreased. The feeding quantity is set to be somewhat smaller (S402 and S403).

If the quantity of the remaining sheets is below the predetermined quantity, the rotation speed of the sheet roll by the roll drive unit 400 is set to be higher than the reference value and the feeding speed of the cut sheets to the sheet stack unit 200 is increased. The feeding quantity is set to be somewhat larger (S402 and S404).

The roll sheet is cut at the set feeding speed and the cut sheets are fed to the sheet stack unit 200 (S405). The cut sheets are fed until the set feeding quantity is reached, thereby stopping the rotation of the roll (S406 and S407).

The cut sheets are thus fed. Therefore, the recording sheets cut from the roll sheet can be stably fed to the image forming apparatus 100.

[Third Embodiment]

An apparatus according to a third embodiment will be described. The basic configuration of the apparatus of this embodiment is the same as the first embodiment and the overlapped description is omitted. The configuration which is the feature of this embodiment will be described here.

<Sheet Stack Unit>

In the first embodiment, the roll sheet is cut by the roll sheet cut unit 300, the cut sheets are stacked in the sheet stack unit 200, and the stacked cut sheets are fed to the image forming apparatus 100. The cut sheets to be fed are stacked on the upper portion of the sheets stacked in the sheet stack unit 200. The sheet stacking operation and the operation of feeding the sheets from the upper portion of the stacked sheet bundle to the image forming apparatus 100 are difficult to be performed at the same time. In this embodiment, plural stack portions are provided in the sheet stack unit 200.

Figure 11A:
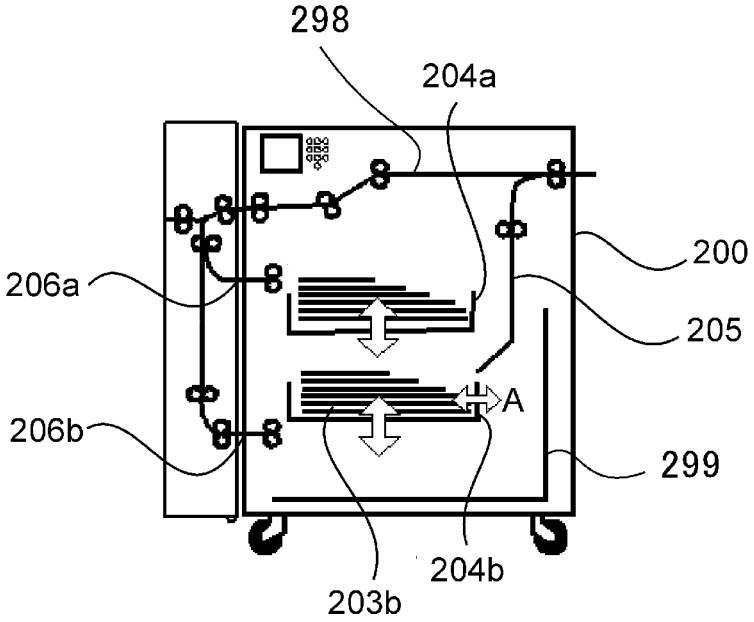
FIGS. 11A and 11B are explanatory views of the configuration of a sheet stack unit according to a third embodiment.
Figure 11B:
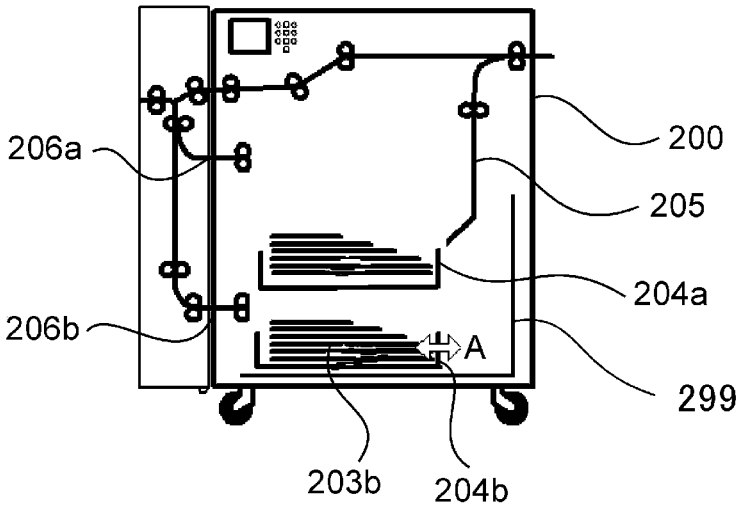

As illustrated in FIGS. 11A and 11B, the sheet stack unit 200 of this embodiment has a first stack portion (a first tray) 203*a* and a second stack portion (a second tray) 203*b*. The sheet stack unit 200 has a receiving path 205 which receives the cut sheets fed from the roll sheet cut unit 300 to the stack portions 203*a* and 203*b*. The sheet stack unit 200 has a first sheet separation feeding portion 206*a* and a second sheet separation feeding portion 206*b* which feed the sheets from the stack portions 203*a* and 203*b* to the image forming apparatus 100. The first sheet separation feeding portion 206*a* separates the uppermost sheet from the sheet bundle stacked in the stack portion 203*a* and feeds it. The second sheet separation feeding portion 206*b* separates the uppermost sheet from the sheet bundle stacked in the second stack portion 203*b* and feeds it. The first sheet separation feeding portion 206*a* and the second sheet separation feeding portion 206*b* constitute a supplying unit which supplies sheets to the image forming apparatus 100.

The two stack portions 203*a* and 203*b* can be moved up and down by a moving mechanism 299. As illustrated in FIG. 11A, when the stack portions 203*a* and 203*b* are moved up, the first sheet separation feeding portion 206*a* is connected to the first stack portion 203*a* and the receiving path 205 is connected to the second stack portion 203*b*. In this state, the cut sheets can be fed from the first stack portion 203*a* to the image forming apparatus 100 and the cut sheets can be fed from the roll sheet cut unit 300 to the second stack portion 203*b*.

As illustrated in FIG. 11B, when the stack portions 203*a* and 203*b* are moved down, the second sheet separation feeding portion 206*b* is connected to the second stack portion 203*b* and the receiving path 205 is connected to the first stack portion 203*a*. In this state, the cut sheets can be fed from the second stack portion 203*b* to the image forming apparatus 100 and the cut sheets can be fed from the roll sheet cut unit 300 to the first stack portion 203*a*.

If there is the only one stack portion stacking the sheets, it is considered that while the sheets are stacked in the stack portion, the sheets cannot be fed from the stack portion and the operation of the image forming apparatus need be stopped. In this embodiment, the two stack portions are provided and are used alternately. When the sheets are fed from the roll sheet cut unit 300 to the sheet stack unit 200 so as to stack the sheets in one of the stack portions, the sheets stacked in the other stack portion are fed to the image forming apparatus 100.

Regulation plates 204*a* and 204*b* which are regulation members regulating and aligning the edge positions of the stacked cut sheets are slidable in the double-headed arrow A direction of FIGS. 11A and 11B by a slide mechanism, not illustrated, in the stack portions 203*a* and 203*b*, respectively. The time for the operation of sliding the regulation plates 204*a* and 204*b* to align the sheet length direction position is necessary. In this embodiment, when the aligning operation is performed by the one stack portion, the sheets are fed from the other stack portion to the image forming apparatus 100. When the sheets are fed to the image forming apparatus 100, the stacked sheets can be aligned.

<Sheet Stack Operation>

The operation of the sheet stack unit 200 of this embodiment will be described.

Figure 12:
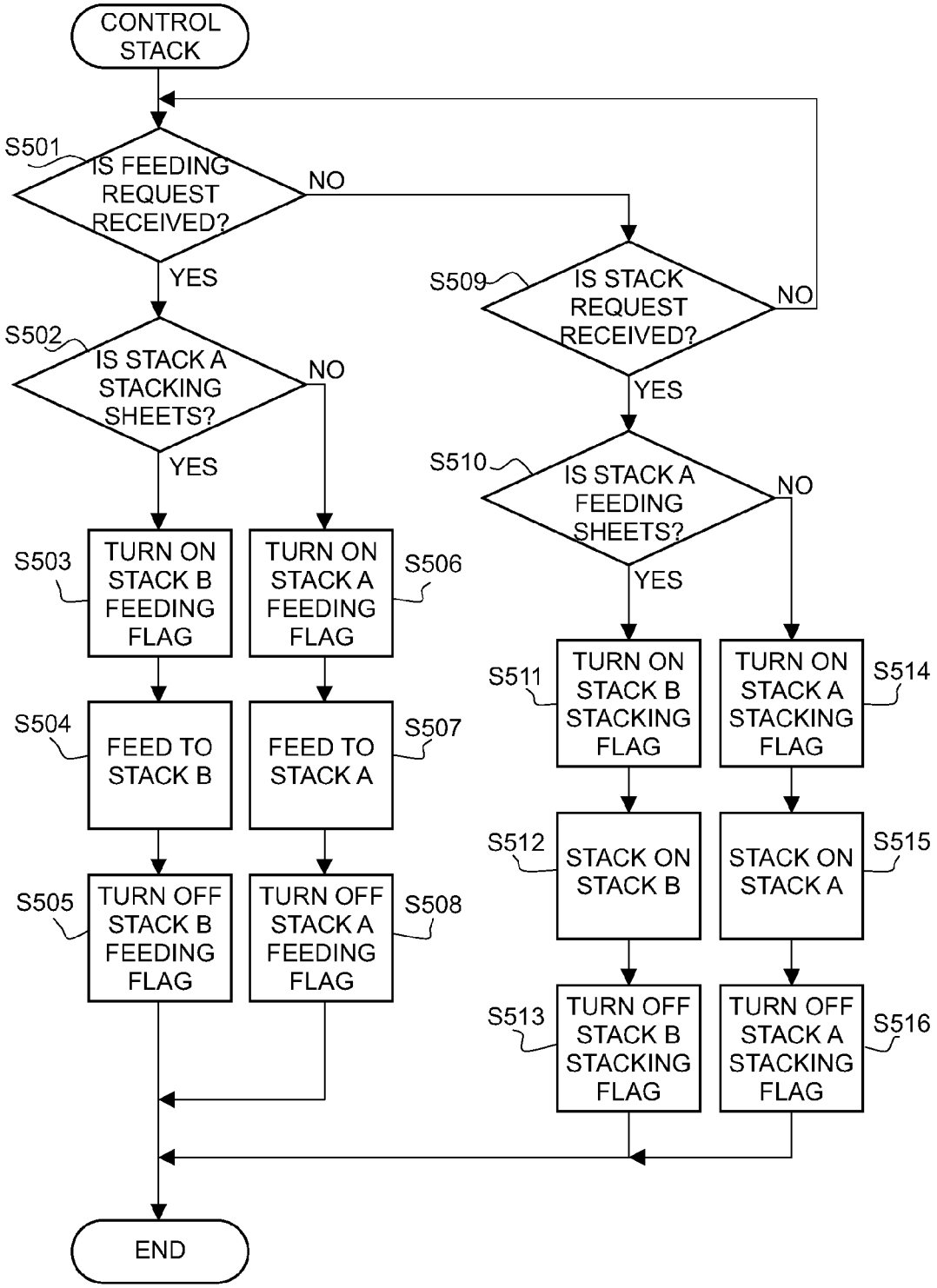
FIG. 12 is a flowchart of cut sheet feeding control according to the third embodiment.

FIG. 12 is an operation flowchart according to the operation of the sheet stack unit 200. It is determined whether there is a feeding request to the sheet stack unit 200 (S501). If the feeding request is received, it is determined whether the first stack portion 203*a* (referred to as a "stack portion A" in FIG. 12) is stacking the sheets (S502). The wording "stacking the sheets" herein will be described later with reference to FIG. 13 and is referred to as a series of operations of receiving the sheets conveyed from the roll sheet cut unit 300, stacking the received sheets, and aligning the stacked sheets.

If the first stack portion 203*a* is stacking the sheets, to feed the sheets from the second stack portion 203*b* (referred to as a "stack portion B" in FIG. 12), the second stack portion 203*b* turns on the sheet feeding flag (S503) to feed the sheets from the second stack portion 203*b* to the image forming apparatus 100 (S504). When the feeding from the second stack portion

203*b* is ended, the second stack portion feeding flag is turned off (S505) and the routine is ended. The wording "feeding the sheets" herein is referred to as the feeding of the sheets from the stack portion to the image forming apparatus 100 and is an operation described later with reference to FIG. 14.

If the first stack portion 203*a* is not stacking the sheets, to feed the sheets from the first stack portion 203*a*, the first stack portion feeding flag is turned on (S506) to feed the sheets from the first stack portion 203*a* (S507). When the feeding from the first stack portion 203*a* is ended, the first stack portion feeding flag is turned off (S508) and the routine is ended.

If there is not the sheet feeding request in S501, it is determined whether the stack request is received (S509). If the sheet stack request is received, it is determined whether the first stack portion 203*a* is feeding the sheets (S510).

If the first stack portion 203*a* is feeding the sheets, to stack the sheets in the second stack portion 203*b* to respond to the received stack request, the second stack portion stacking flag is turned on (S511) to stack the sheets in the second stack portion 203*b* (S512). When the stacking in the second stack portion 203*b* is ended, the second stack portion stacking flag is turned off (S513) and the routine is ended.

If the first stack portion 203*a* is not feeding the sheets, to stack the sheets in the first stack portion 203*a* to respond to the received stack request, the first stack portion stacking flag is turned on (S514) to stack the sheets in the first stack portion 203*a* (S515). When the stacking operation in the first stack portion 203*a* is ended, the first stack portion 203*a* stacking flag is turned off (S516) and the routine is ended.

Figure 13:
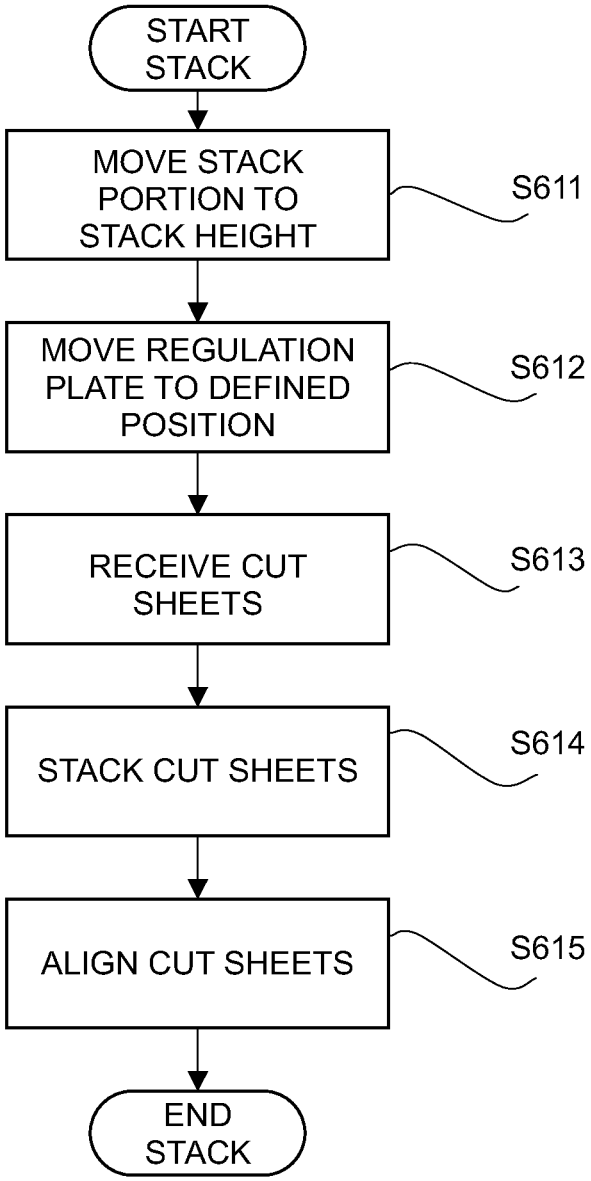
FIG. 13 is a flowchart of cut sheet feeding control according to the third embodiment.

FIG. 13 is a flowchart illustrating the operation of stacking the sheets into the stack portion.

When the sheets are received in the stack portion, the stack portion is moved to the height suitable for receiving the sheets and is coupled to the receiving path 205 (S611). The regulation plate is moved to the defined position (the retracted position) which is easy to receive the sheets (S612). When the sheets are ready to be received, the cut sheets are received (S613) to sequentially stack the received sheets (S614). The aligning of the sheet edge positions by the regulation plate is executed to the stacked sheets (S614).

Figure 14:
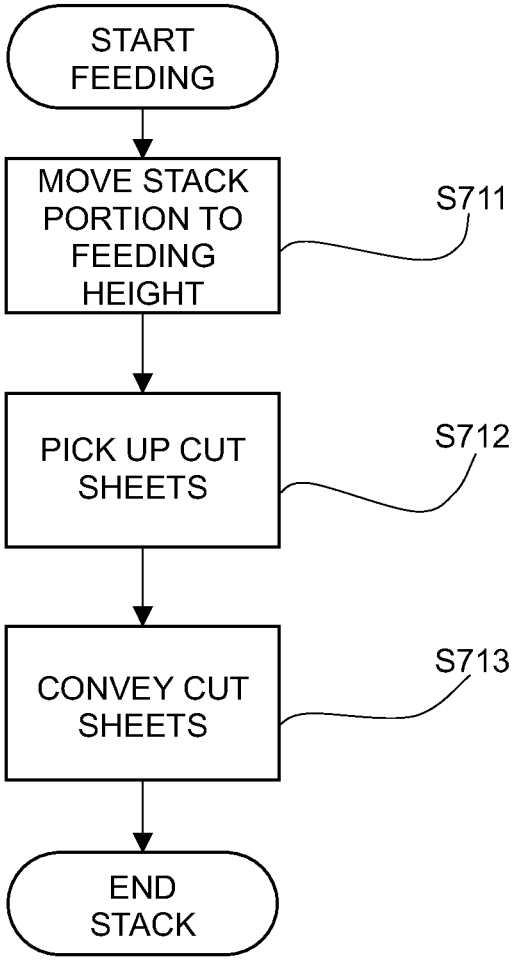
FIG. 14 is a flowchart of cut sheet feeding control according to the third embodiment.

FIG. 14 is a flowchart illustrating the operation of feeding the sheets from the stack portion.

The stack portion is moved to the height suitable for the sheet feeding operation (S711) to pick up one of the stacked sheets (S712). The pickup sheet is conveyed to the image forming apparatus 100 (S713).

In this embodiment, the plural sheet stack portions are provided. The reception of the sheets from the roll sheet cut unit 300 and the feeding of the sheets to the image forming apparatus 100 can be performed at the same time.

The sheet stack unit 200 has a direct conveying path 298 which conveys the sheets received from the roll sheet cut unit 300 to the image forming apparatus 100 not via the first stack portion and the second stack portion. The direct conveying path 298 is a conveying path used for feeding the sheets of a size other than the predetermined size of the sheets stacked in the sheet stack unit 200 to the image forming apparatus 100.

[Modification of the Third Embodiment]

The form in which the receiving path 205 has one outlet and each of the plural stack portions is moved to the position receiving the sheets from the outlet of the receiving path 205 and the position feeding the stacked sheets by the first and second sheet separation feeding portions 206*a* and 206*b* has been described as the third embodiment. The form may be configured as in the modification illustrated in FIG. 15.

Figure 15:
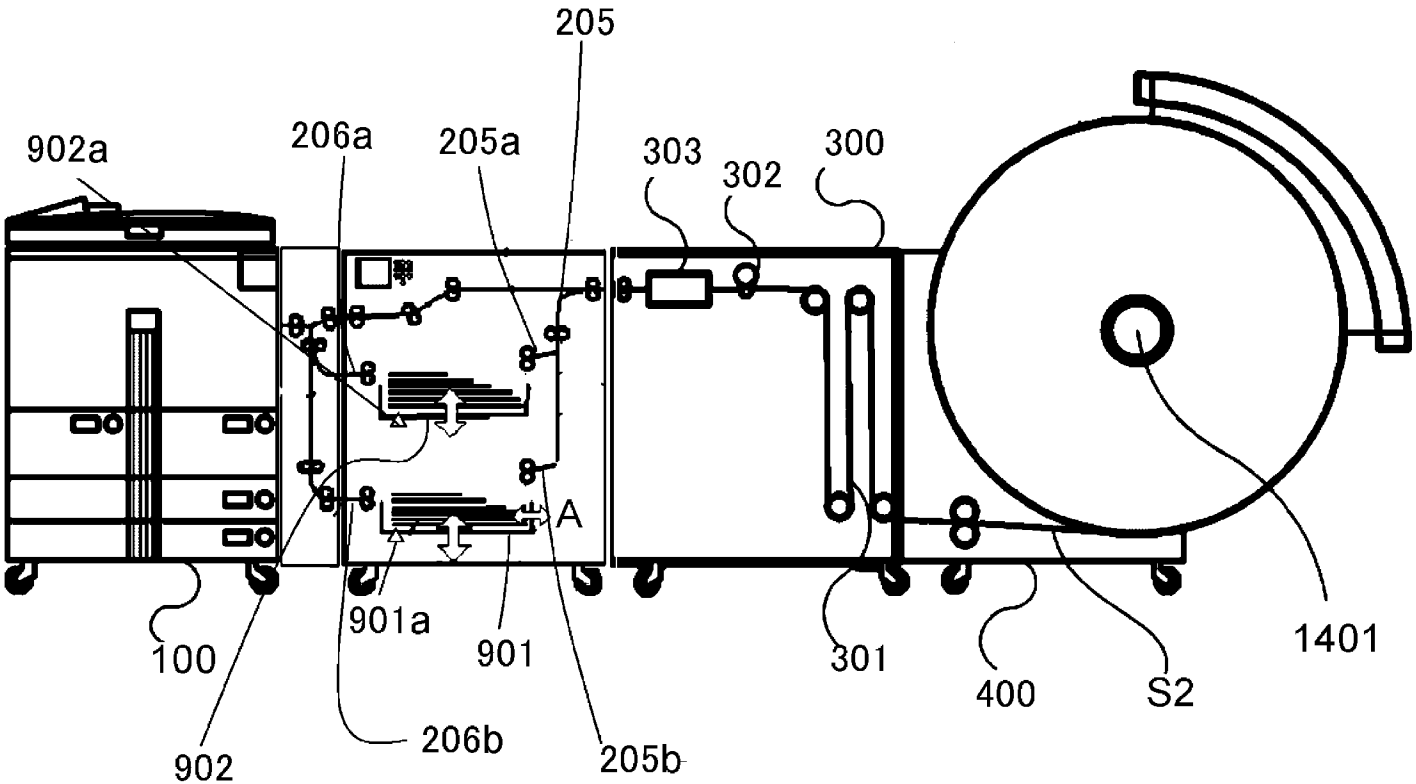
FIG. 15 is a diagram illustrating the configuration of the image forming system according to a modification of the third embodiment.
Figure 16:
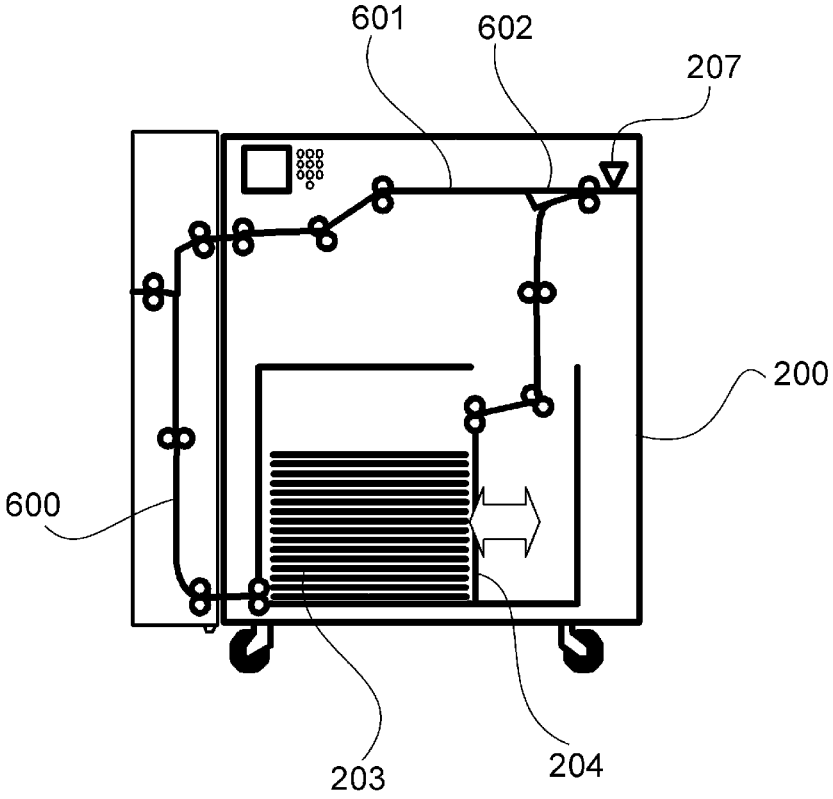
FIG. 16 is an explanatory view of the configuration of the sheet stack unit according to a fourth embodiment.

In the image forming system illustrated in FIG. 15, the receiving path 205 is branched into two and the outlets of the branched conveying paths are opposite the two stack portions (stack trays). The receiving path 205 which receives the sheets conveyed from the roll sheet cut unit 300 and conveys the sheets is divided into an upper path 205*a* and a lower path 205*b* on the downstream side in a sheet conveying direction. The sheets which pass through the upper path 205*a* are discharged onto a first stack tray 902 and are stacked on the first stack tray 902. The sheets which pass through the lower path 205*b* are discharged onto a second stack tray 901 and are stacked in the second stack tray 901. The first stack tray 902 and the second stack tray 901 are independently moved up and down according to the stack quantity so as to be located in the position suitable for feeding the uppermost one of the stacked sheets by the first sheet separation feeding portion 206*a* and the second sheet separation feeding portion 206*b*.

The stacking of the sheets into the sheet stack unit 200 and the operation of feeding the sheets from the sheet stack unit 200 may be executed as follows. When the first stack tray 902 is empty while the sheets are continuously fed from the first stack tray 902 to the image forming apparatus 100, the sheets are fed from the second stack tray 901. At that time, the sheets are fed from the roll sheet cut unit 300 to the empty first stack tray 902 so that the sheets are stacked in the first stack portion 205*a*. It is determined based on a first sheet presence/absence sensor 902*a* that the first stack tray 902 is empty.

When the second stack tray 901 is empty while the sheets are fed from the second stack tray 901 to the image forming apparatus 100, the sheets are fed from the first stack tray 902. At that time, the sheets are fed from the roll sheet cut unit 300 to the empty second stack tray 901 so that the sheets are stacked on the second stack tray 901. It is determined based on a second sheet presence/absence sensor 901*a* that the second stack tray 901 is empty.

[Fourth Embodiment]

An apparatus according to a fourth embodiment will be described. The basic configuration of the apparatus of this embodiment is the same as the first embodiment and the overlapped description is omitted. The configuration which is the feature of this embodiment will be described here.

<Sheet Stack Unit>

In the first embodiment, the cut sheets fed from the roll sheet cut unit 300 are stacked in the sheet stack unit 200 and are then fed to the image forming apparatus 100.

In the first embodiment, only the sheets stacked in the sheet stack unit 200 can be fed to the image forming apparatus 100. When the recording sheets of a different size are desired to be fed to the image forming apparatus 100, the sheets remaining in the sheet stack unit 200 need be removed by the user or be automatically discharged.

In the present embodiment, the sheets of a size different from the size of the sheets stacked in the sheet stack unit 200 can be fed to the image forming apparatus 100.

In this embodiment, there is provided the direct conveying path which feeds the sheets cut by the roll sheet cut unit 300 to the image forming apparatus 100 not via the sheet stack unit 200.

When the sheets of a size other than the predetermined size of the sheets stacked in the sheet stack unit 200 are fed to the image forming apparatus 100, they pass through the direct conveying path and are then fed to the image forming apparatus 100.

Specifically, as illustrated in FIG. 15, the sheet stack unit 200 of this embodiment has a direct feeding portion 601 including the direct conveying path besides a sheet supplying unit 600 which feeds (supplies) the sheets stacked in the sheet stack portion 203 to the image forming apparatus 100. The direct feeding portion 601 is a feeding unit which directly feeds the cut sheets fed from the roll sheet cut unit 300 to the image forming apparatus 100, not to the sheet stack portion 203. A switching member 602 which switches the sheet destinations is provided in the branch portion of the sheet supplying unit 600 and the direct feeding portion 601. The switching member 602 is operated to allocate the cut sheets fed from the roll sheet cut unit 300 to the sheet supplying unit 600 or the direct feeding portion 601.

<Sheet Feeding Operation>

In the above configuration, by the input from the operation portion, when the setting of the selected recording sheet size and the setting of the size of the sheets stacked in the stack portion 203 are the same, the sheets are automatically fed from the stack portion 203 by the sheet supplying unit 600.

By the input from the operation portion, when the setting of the selected recording sheet size and the setting of the size of the sheets stacked in the stack portion 203 are different, the sheets are cut to the selected recording sheet size by the roll sheet cut unit 300 and the cut sheets are fed by the direct feeding portion 601.

The sheets are thus fed. Therefore, the sheets of a size other than the size of the sheets stacked in the sheet stack unit 200 can be fed to the image forming apparatus 100 without providing the plural sheet stack portions. Thus, the recording sheets of an arbitrary size can be fed to the image forming apparatus 100 without making the apparatus larger.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-288355, filed Nov. 11, 2008, which is hereby incorporated by reference herein in its entirety.

What is claimed is:

1. An image forming system comprising:

a sheet feeding unit which cuts a roll sheet and feeds cut sheets;

a stack portion on which the cut sheets that have been cut and fed by the sheet feeding unit are stacked;

a supplying unit which supplies the cut sheets stacked on the stack portion;

an image forming portion which forms an image on the cut sheets supplied by the supplying unit; and a bypass which bypasses the stack portion and which guides the cut sheets that have been cut and fed by the sheet feeding unit to the image forming portion without stacking the cut sheets.

2. The image forming system according to claim 1, further comprising:

a controlling unit configured to control the feeding unit and the supplying unit so that the supplying unit supplies a cut sheet stacked on the stack portion to the image forming portion while the sheet feeding unit feeds a cut sheet to the stack portion to stack the sheet on the stack portion; and a stack quantity detection unit which detects the stack quantity of the sheets stacked in the stack portion, wherein the controlling unit changes a operation of the feeding unit according to the stack quantity detected by the stack quantity detection unit.

3. The image forming system according to claim 1, further comprising:

a controlling unit configured to control the feeding unit and the supplying unit so that the supplying unit supplies a cut sheet stacked on the stack portion to the image forming portion while the sheet feeding unit feeds a cut sheet to the stack portion to stack the sheet on the stack portion; and a stack quantity detection unit which detects the stack quantity of the sheets stacked in the stack portion, wherein when an image forming interval for each of the sheets in the image forming portion at the time of continuous image formation is t1 and the feeding interval for each of the sheets at the time of continuous feeding of the sheets cut by the sheet feeding unit to the stack portion is t2, the sheet feeding unit can switch between a first sheet feeding state which feeds the sheets to the stack portion so that t1 <t2 and a second sheet feeding state which feeds the sheets to the stack portion so that t1 >t2 and switches between the first sheet feeding state and the second feeding state according to the stack quantity detected by the stack quantity detection unit, wherein the controlling unit starts the first sheet feeding state according to a detection result of the stack quantity detection unit indicating that the stack quantity is above a first predetermined quantity, and the controlling unit starts the second sheet feeding state according to a detection result of the stack quantity detection unit indicating that the stack quantity is below a second predetermined quantity that is smaller than the first predetermined quantity.

4. The image forming system according to claim 1, wherein the supplying unit separates the lowermost sheet stacked in the stack portion and supplies the lowermost sheet to the image forming portion.

5. The image forming system according to claim 1, wherein the supplying unit separates the uppermost sheet stacked in the stack portion and supplies the uppermost sheet to the image forming portion.

6. The image forming system according to claim 1, the stack portion comprising:

a first tray and a second tray on which the sheets fed by the sheet feeding unit are stacked, wherein the supplying unit supplies the sheets stacked on the first tray and the second tray to image forming portion, and wherein while a sheet is fed from the sheet feeding unit to the stack portion so that the sheet from the sheet feeding unit is stacked on one of the first tray and the second tray, a sheet stacked on the other of the first tray and the second tray is supplied to the image forming portion by the supplying unit.

7. The image forming system according to claim 1, further comprising a controlling unit configured to control supply of a sheet cut in a different size from a sheet stacked in the stacked portion to the image forming portion via the bypass.

8. The image forming system according to claim 1, further comprising a controlling unit configured to control the feeding unit and the supplying unit so that the supplying unit supplies a cut sheet stacked on the stack portion to the image forming portion while the sheet feeding unit feeds a cut sheet to the stack portion to stack the sheet on the stack portion.

9. The image forming system according to claim 1, wherein the bypass is disposed above the stack portion.

10. An image forming system comprising:

a sheet feeding unit which cuts a roll sheet and feeds cut sheets;

a first tray and a second tray on which the cut sheets that have been cut and fed by the sheet feeding unit are stacked;

a supplying unit which supplies the cut sheets stacked on the first tray and the second tray;

an image forming portion which forms an image on the cut sheets supplied by the supplying unit; and a bypass which bypasses the first tray and the second tray and which guides the cut sheets that have been cut and fed by the sheet feeding unit to the image forming portion without stacking sheets.

11. The image forming system according to claim 10, wherein the supplying unit includes a first separation feeding portion which separates and feeds the uppermost one of the sheets stacked on the first tray and a second separation feeding portion which separates and feeds the uppermost one of the sheets stacked on the second tray.

12. The image forming system according to claim 10, further comprising a first aligning member which can be moved to align the stacked sheets on the first tray; and an second aligning member which can be moved to align the stacked sheets on the second tray.

13. The image forming system according to claim 10, wherein a stack unit supports the first tray and the second tray so as to be lifted and lowered.

14. The image forming system according to claim 10, further comprising a controlling unit configured to control supply of a sheet cut in different size from a sheet stacked in the stacked portion to the image forming portion via the bypass.

15. The image forming system according to claim 10, further comprising a controlling unit configured to control the feeding unit and the supplying unit so that while a cut sheet is fed from the sheet feeding unit to one of the first tray and the second tray to stack the cut sheet from the sheet feeding unit on one of the first tray and the second tray, a sheet stacked on the other of the first tray and the second tray is supplied to the image forming portion by the supplying unit.

16. The image forming system according to claim 10, wherein the bypass is disposed above the first tray and the second tray.

17. An image forming system comprising:

a sheet feeding unit which cuts a roll sheet and feeds cut sheets;

a feeding path which guides the cut sheets fed by the sheet feeding unit;

a stack portion on which the cut sheets guided by the feeding path are stacked;

a supplying unit which supplies the cut sheets stacked on the stack portion;

a supplying path which guides the cut sheets supplied by the supplying unit;

an image forming portion which forms an image on the cut sheets guided by the supplying path; and a bypass, which branches from the feeding path and joins into the supplying path for bypassing the stack portion, configured to guide the cut sheets that have been cut and fed by the sheet feeding unit to the image forming portion without stacking sheets.

18. The image forming system according to claim 17, further comprising a controlling unit configured to control the image forming system so as to supply a sheet cut in different size from a sheet stacked in the stacked portion to the image forming portion via the bypass.

19. The image forming system according to claim 17, further comprising a controlling unit configured to control the feeding unit and the supplying unit so that the supplying unit supplies a cut sheet stacked on the stack portion to the image forming portion while the sheet feeding unit feeds a cut sheet to the stack portion to stack the sheet on the stack portion.

20. The image forming system according to claim 17, wherein the bypass is disposed above the stack portion.

* * * * *